US005131700A

United States Patent [19]

Mannato

[11] Patent Number: 5,131,700

[45] Date of Patent: Jul. 21, 1992

[54] SNAP LATCH, PARTICULARLY FOR BAGS, LADIES HANDBAGS, OR OTHER TRAVELING ARTICLES

[75] Inventor: Pietro Mannato, Bologna, Italy

[73] Assignee: Finduck S.r.l., Cadriano di Granarolo, Italy

[21] Appl. No.: 668,189

[22] Filed: Mar. 12, 1991

[30] Foreign Application Priority Data

Mar. 11, 1991 [IT] Italy ..... 4771/90[U]

[51] Int. Cl.[5] ..... E05C 3/14

[52] U.S. Cl. ..... 292/204; 292/DIG. 50

[58] Field of Search ..... 292/204, 202, 194, 246, 292/DIG. 50, 209, 247

[56] References Cited

U.S. PATENT DOCUMENTS

| | | | |
|---|---|---|---|
| D. 203,645 | 2/1966 | Koret | 292/246 X |
| 1,634,918 | 7/1927 | Steinman | 292/DIG. 50 X |
| 2,016,551 | 10/1935 | Landis | 292/DIG. 50 |
| 2,158,548 | 5/1939 | Lemire et al. | 292/DIG. 50 X |
| 3,047,322 | 7/1962 | Karron | 292/DIG. 50 X |

FOREIGN PATENT DOCUMENTS

| | | | |
|---|---|---|---|
| 748194 | 4/1956 | United Kingdom | 292/DIG. 50 |

*Primary Examiner*—Richard E. Moore
*Attorney, Agent, or Firm*—Larson & Taylor

[57] ABSTRACT

A snap latch, particularly for bags, ladies handbags, or other traveling articles, characterized in that it comprises a base member (1) designed to be fixed on one of the portions (P1) to be closed of the bag and having pivoted thereto in book-like fashion a body member (3) which can be oscillated through 180° and which, when abutted against the base member, protrudes therefrom with a portion (103) whose face opposite the bag is provided with a seat (8) which is partly closed by the upper edge (401) of the base member and which at the opposite part is closed by an hook-like eyelid-shaped member (303) integral with the body member, a protruding button (7) being secured on the other portion (P2) to be closed of the bag, so that when the portions of the bag are in the closed position, the button is disposed with its rounded head partly on the upper edge (401) of the base member and when the swingable body member (3) is abutted against the base member, the head snaps into the seat (8) of the body member and is grasped by the hook-like member (303) of the seat, the distance between the rounded edge (6) of the hook-like member and the adjacent upper edge (401) of the base member being smaller than the diameter (D) of the button head, whereby the latter will be firmly retained within the seat (8), unless the swingable body member (3) is intentionally rotated away from the button and respective supporting base member.

2 Claims, 2 Drawing Sheets

SNAP LATCH, PARTICULARLY FOR BAGS, LADIES HANDBAGS, OR OTHER TRAVELING ARTICLES

SUMMARY OF THE INVENTION

The invention relates to a snap latch, particularly for bags, ladies handbags, or other traveling articles.

The snap latch according to the invention is characterized in that it comprises a base member designed to be fixed on one of the portions to be closed of the bag, and having pivoted thereto in book-like fashion a body member which can be oscillated through 180° and which, when abutted against the base member, protrudes therefrom with a portion whose face opposite the bag is provided with a seat which is partly closed by the upper edge of the base member and which at the opposite part is closed by an hook-like eyelid-shaped member integral with said body member, a protruding button being secured on the other portion to be closed of the bag, so that when said portions of the bag are in the closed position said button is disposed with its rounded head partly on the upper edge of the base member and when the swingable body member is abutted against said base member, said head snaps into the seat of said body member and is grasped by hook-like member of said seat, the distance between the rounded edge of the hook-like member and the adjacent upper edge of the base member being smaller than the diameter of the button head, whereby the latter will be firmly retained within said seat, unless the swingable body member is intentionally rotated away from said button and respective supporting base member.

BRIEF DESCRIPTION OF THE DRAWINGS

The characteristics and advantages of the snap latch according to the invention will become apparent from the following description made with reference to the Figures of the accompanying single sheet of drawings, wherein.

DESCRIPTION OF THE PREFERRED EMBODIMENT

Figure 3:
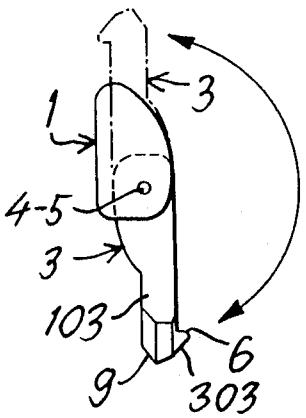
FIGS. 1, 2 and 3 are outer side, inner side and end side elevational views, respectively, of the latch.

From the Figures, it will be appreciated that the latch comprises an inverted U base member 1 provided in its rear side with threaded blind holes 2 for securing it by means of screws to the portion P1 of a bag, and provided at the ends of its exposed face with parallel equal protrusions 101, which, in side view, have an outline which is similar to the cross mid-section outline of an orange division (FIG. 3). The side faces of the protrusions 101 are parallel to each other and perpendicular to the base member 1. The generatrix of the surface 301 of said protrusions 101 is rectilinear and perpendicular to the faces 201.

Figure 4:
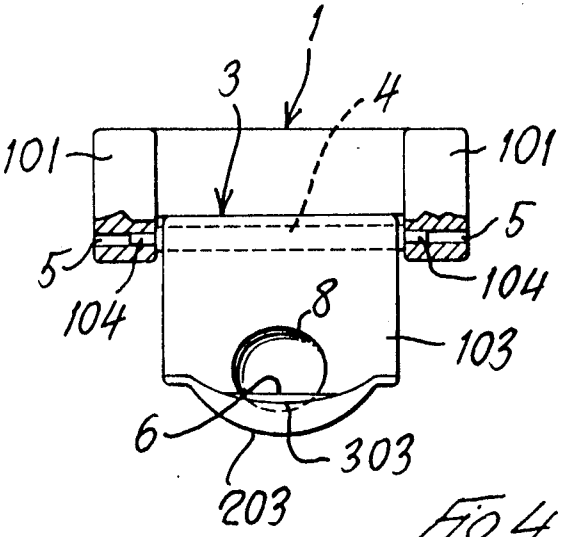
FIG. 4 shows the latch as in FIG. 1 and with the swingable member in the opened position.

Arranged between the protrusions 101 is a body member 3 which is pivoted on a spindle 4 which is perpendicular to said protrusions. More particularly (see FIG. 4), the protrusions 101 are provided with equal through-holes 5 in line with each other and with a hole of larger diameter in the body member 3 which receives a spindle 4 of the type which is sued to connect a strap to the body of a watch. Said spindle 4 is provided with spring-urged end projections 104 for engagement in the holes 5 of the protrusions 101.

It is to be understood that the pivotal connection of the body member 3 to the protrusions 101 may be carried out by means of a spindle 4 other than that described above.

The body member 3 can effect a 180° oscillation about the spindle 4 (FIG. 3).

Figure 2:
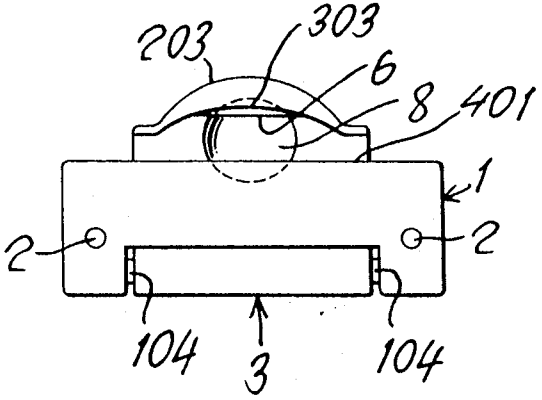
Figure 1:
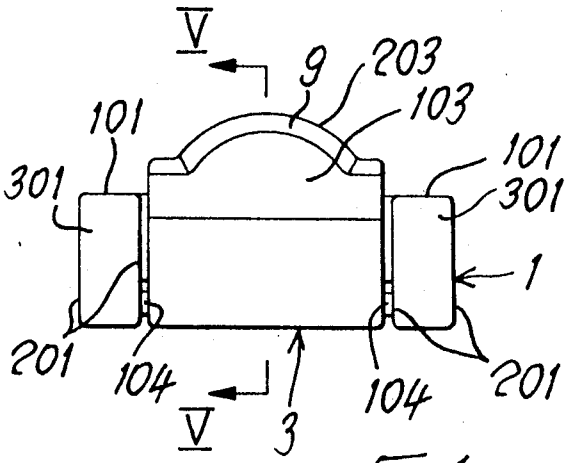
Figure 5:
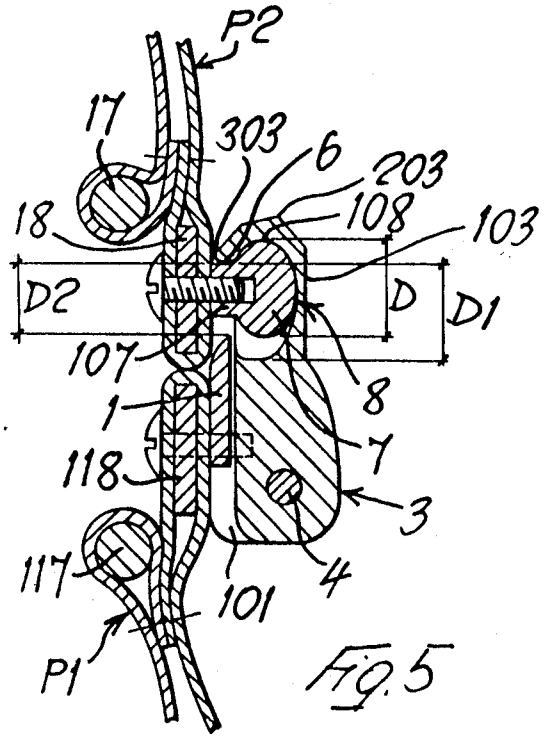
FIG. 5 shows the latch in its operative position, in cross section on the line V—V of FIG. 1.

When the body member 3 is in the position abutting against the base member 1, as shown in the FIGS. 1, 2, 5, its outline is flush with the outline of the protrusions 101 wherefrom said body member protrudes with a flattened portion 103 which, in front view as in FIG. 1, terminates in an outline having the shape of the upper case Greek letter "omega", much flattened and with a chamfered edge 9.

In the face opposite to the base member 1, the portion 103 of the body member 3 is provided with a central blind hole 8 of suitable size which is partly overlapped by the edge 401 of the base member and which is overlapped on the opposite side by an hook-like or eyelid-shaped member 303 integral with and protruding from the rear side of said portion 103 of the swingable body member, and appearing in front view as shown in FIG. 2. Under the hook-like member 303, the hole 8 comprises a preferably rounded portion 108 (FIG. 5). The edge 6 of the hook-like member 303 is also suitable rounded.

In order to simplify the construction of the hole 8 with its undercut portion 108, it is not to be excluded that said hole may be completely or partly opened in the exposed face of the portion 103 of said swingable body.

The latch of the invention is completed by a button 7 provided with a rounded, comparatively flattened head, and with a stem 107 which is axially drilled and threaded to be secured by means of a screw on the portion P2 of the bag to be connected and secured to the portion P1 which is provided with the device 1–3 described above.

The button 7 is secured to the portion P2 so that it can afford a small elastic oscillation on its anchorage point, for the purpose specified hereinafter.

It should be noted in FIG. 3 that the distance D1 between the edge 6 of the hook-like member 303 and the opposite edge of the hole 8, is suitably larger than the diameter D of the head of said button 7, whereas the distance D2 between said edge 6 and the edge 401 of the base member 1 is smaller than said diameter D.

The latch described above is particularly suitable for use on flaps having an opening movement similar to that of a rolling shutter, as described in a separate patent application in the name of the same applicant, but it can also be used on flaps or other portions of bags or the like, having any other movement.

The parts 7 and 103 of the latch may be used as grip projections for relatively moving the flaps P1, P2.

The operation of the latch devised as above is simple and apparent.

When the flaps P1 and P2 of the bag abut each other via the slats 18, 118 whereon the parts 1 and 7 of the latch are secured, the head of the button 7 partly overlaps the edge 401 of the base member 1. By bringing the part 103 of the swingable body member 3 against the base member 1, the edge 6 of the hook-like member 303 frictionally co-operates with the rounded head of the button 7 which snaps into the hole 8 and engages the recessed portion 108 formed below said hook-like member. Evidently, in the condition of FIG. 5, any casual movement of the parts 7 and 1–3 away from each other is prevented because the distance D2 is smaller that the diameter D of the button head. In order to open the latch, the body member 3 must be rotated away from the button 7 because only by this procedure said button can get out of the blind hole 8.

I claim:

1. A snap latch, particularly suitable for bags, handbags and other traveling articles, characterized in that it comprises a base member (1) designed to be fixed on one of the portions (P1) to be closed of the bag, and having pivoted thereto a body member (3) which can be oscillated through 180° and which, when abutted against the base member, protrudes therefrom with a portion (103) whose face opposite the bag is provided with a seat (8) which is partly closed by the upper edge (401) of the base member and which at the opposite part is closed by an hook-like eyelid-shaped member (303) integral with said body member, a protruding button (7) being secured on the other portion (P2) to be closed of the bag, so that when said portions of the bag are in the closed position said button is disposed with its rounded head partly on the upper edge (401) of the base member and when the swingable body member (3) is abutted against said base member, said head snaps into the seat (8) of said body member and is grasped by the hook-like member (303) of said seat, the distance between the rounded edge (6) of the hook-like member and the adjacent upper edge (401) of the base member being smaller than the diameter (D) of the button head, whereby the latter will be firmly retained within said seat (8), unless the swingable body member (3) is intentionally rotated away from said button and respective supporting base member.

2. A snap latch according to claim 1 wherein the rounded head button (7) is secured on the respective portion (P2) to be closed of the bag so as to be slightly oscillated resiliently on the anchorage point, whereby it can snappingly engage the seat (8) of the swingable body member (3) which is mounted on the other portion (P1) to be closed of the bag.

* * * * *